US006510594B2

(12) United States Patent
Lin

(10) Patent No.: US 6,510,594 B2
(45) Date of Patent: Jan. 28, 2003

(54) ZIPPER SLIDE FOR INVISIBLE ZIPPER

(76) Inventor: Yu-Pau Lin, No. 151, Kung Erh Road, Wu Lin Tsuen, Lung Tan Hsiang, Tao Yuan Hsien (TW)

( * ) Notice: Subject to any disclaimer, the term of this patent is extended or adjusted under 35 U.S.C. 154(b) by 0 days.

(21) Appl. No.: 09/883,283

(22) Filed: Jun. 19, 2001

(65) Prior Publication Data

US 2002/0178553 A1 Dec. 5, 2002

(30) Foreign Application Priority Data

May 30, 2001 (TW) ..... 90208911 U

(51) Int. Cl.[7] ..... A44B 19/30; A44B 19/26
(52) U.S. Cl. ..... 24/421; 24/419; 24/424
(58) Field of Search ..... 24/424, 420–423

(56) References Cited

U.S. PATENT DOCUMENTS 4,679,281 A * 7/1987 Ishii et al. ..... 24/419
5,255,418 A * 10/1993 Chen ..... 24/419
5,544,394 A * 8/1996 Yaguramaki ..... 24/424
5,551,129 A * 9/1996 Chu ..... 24/419
5,611,121 A * 3/1997 Akeno et al. ..... 24/419
5,625,927 A * 5/1997 Chu ..... 24/415
5,625,928 A * 5/1997 Terada et al. ..... 24/421
5,771,546 A * 6/1998 Minato ..... 24/419
5,809,622 A * 9/1998 Yaguramaki ..... 24/419
5,864,928 A * 2/1999 Matsushima ..... 24/419
6,314,624 B1 * 11/2001 Lin ..... 24/421

* cited by examiner

*Primary Examiner*—Robert J. Sandy
*Assistant Examiner*—André L. Jackson
(74) *Attorney, Agent, or Firm*—Rosenberg, Klein & Lee

(57) ABSTRACT

A zipper slide for invisible zipper is constructed to include a slide base, a hook plate, a spring element, a locating plate, and a pull tab, the hook plate being secured to the slide base at a top side, the hook plate having a hook tip hooked up with a coupling ring at one end of the pull tab, the spring plate being pressed on the hook plate, the slide base, the hook plate, the spring element and the connecting plate being fully automatically fastened together by an automatic stamping machine.

1 Claim, 7 Drawing Sheets

POIOR ART

ZIPPER SLIDE FOR INVISIBLE ZIPPER

BACKGROUND OF THE INVENTION

The present invent relates to invisible zippers and, more specifically to a zipper slide for invisible zipper, which can easily be assembled by an automatic machine.

FIG. 1 shows a zipper slide for invisible zipper according to the prior art. This structure of zipper slide 1 comprises a slide base 10, a swivel hook plate 11, a spring 12, and a pull tab 13. The hook plate 11 has a middle part pivoted to the slide base 10 by a rivet 111. The pull tab 13 is coupled to one end of the hook plate 11. The spring 12 is mounted in the slide base 1 and connected between a part-of the slide base 1 and the one end of the hook plate 11. This structure of zipper slide 1 is functional. However, because the hook plate 11 is pivotally connected to the slide base 10 by the rivet 111, the assembly of the zipper slide consumes much labor and, cannot be achieved by a fully automatic machine.

SUMMARY OF THE INVENTION

The present invention has been accomplished to provide a zipper slide for invisible zipper, which eliminates the aforesaid drawback. It is the main object of the present invention to provide a zipper slide for invisible zipper, which can be assembled by an automatic machine to save labor and to reduce the manufacturing cost. According to the present invention, the zipper slide for invisible zipper comprises a slide base having a longitudinally extended partition block, a hook plate mounted in a recessed receiving chamber in the partition block of the slide base, a spring element mounted in the slide base and pressed on the hook plate to hold down the hook plate in position, a locating plate fixedly fastened to the slide base, and a pull tab coupled to a hooked tip of the hook plate by a coupling ring. The slide base, the hook plate, the spring element and the connecting plate are fully automatically fastened together by a stamping machine.

DETAILED DESCRIPTION OF THE PREFERRED EMBODIMENT

Figure 1:
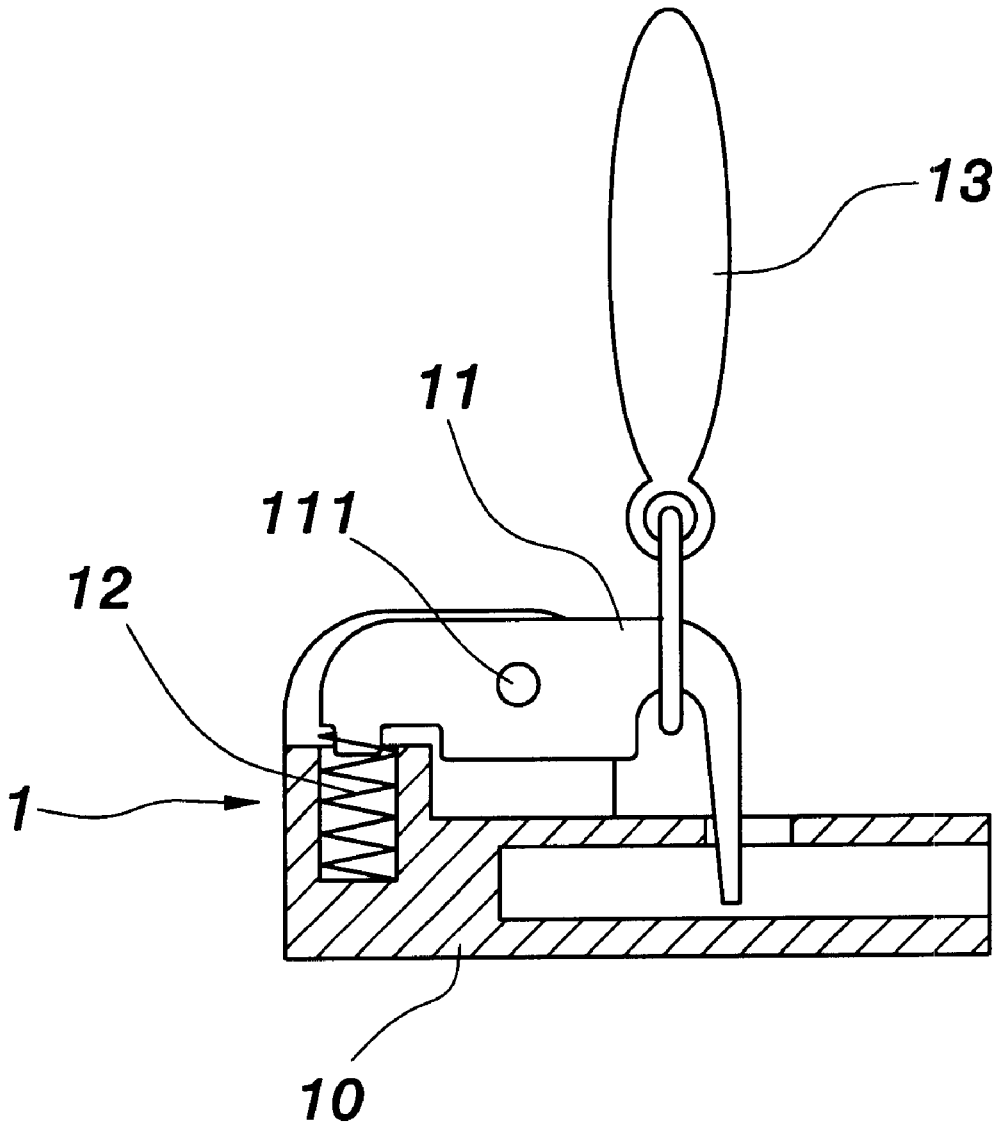
FIG. 1 is a sectional assembly view of a zipper slide for invisible zipper constructed according to the prior art.

Referring to FIGS. from 2 through 7, a zipper slide 70 for invisible zipper in accordance with the present invention is shown comprising a slide base 20, a hook plate 30, a spring element 40, a locating plate 50, and a pull tab 60. An automatic machine to save labor cost assembles the zipper slide 70.

The slide base 20 is made of metallic material, for example, aluminum alloy or zinc alloy, comprising two parallel guide ways 21, which receive the respective zipper tapes (not shown) and have a respective rear part disposed in communication with each other, and a longitudinally extended upright partition block 22, which separates the guide ways 21. The upright partition block 22 comprises a recessed receiving chamber 23, having a first receiver 232 which receives the hook plate 30, a second receiver 231 that receives the spring element 40, and a hook hole 24 in one end of the recessed receiving chamber 23.

The hook plate 30 is made of metallic material, for example, aluminum alloy or zinc alloy, having one end terminating in a hooked tip 31 hooked in the hook hole 24 of the partition block 22 of the slide base 20, an opposite end terminating in a bearing point 32 supported in the first receiver 232 of the recessed receiving chamber 23 of the slide base 20, and a top face 33 disposed at a top side thereof between the hooked tip 31 and the bearing point 32 and adapted to support the spring element 40.

Figure 3:
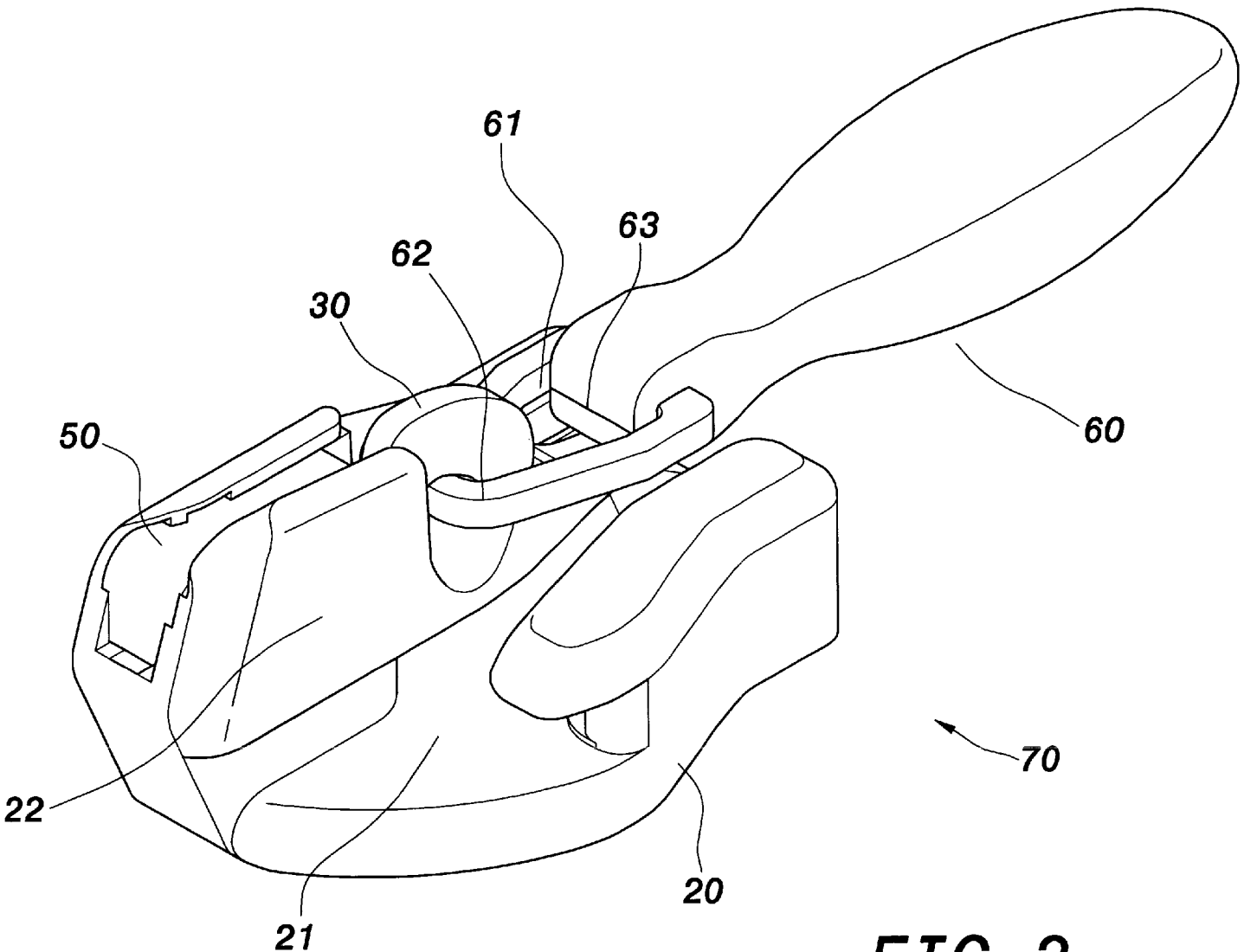
FIG. 3 is an elevational assembly view of the zipper slide for invisible zipper according to the present invention.

The pull tab 60 is made of metallic material, for example, aluminum alloy or zinc alloy, having a knuckle 63 at its one end to which a coupling ring 62 is pivoted for coupling the pull tab 60 to the hooked tip 31 of the hook plate 30. The coupling ring 62 defines a hole 61 through which the hooked tip 31 of the hook plate 30 passes. As indicated in FIG. 3, the coupling ring 62 couples the pull tab 60 to the hook plate 30. Further, the pull tab 60 can be marked with a trademark or logo.

Figure 2:
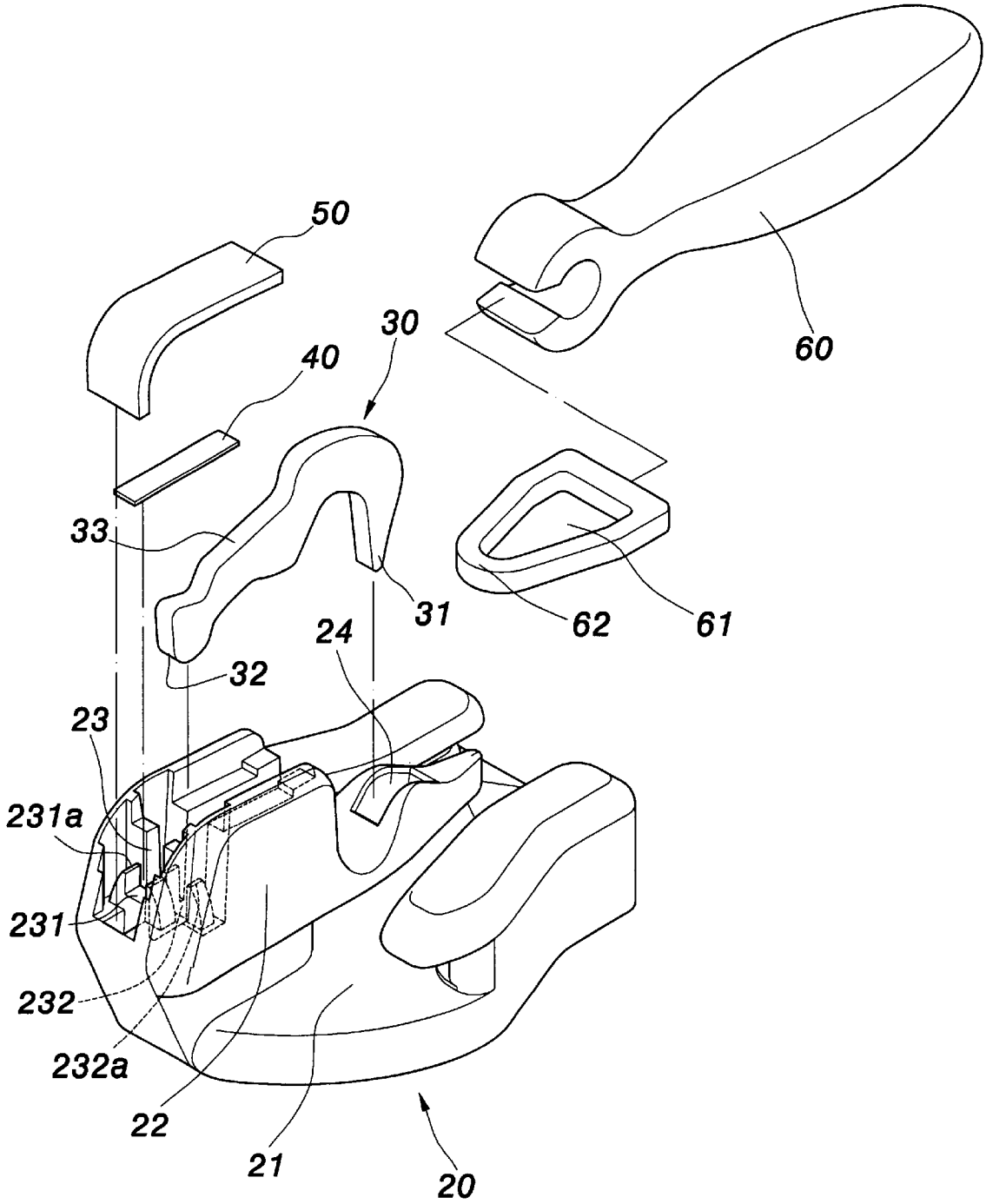
FIG. 2 is an exploded view of a zipper slide for invisible zipper constructed according to a first embodiment of the present invention.
Figure 4:
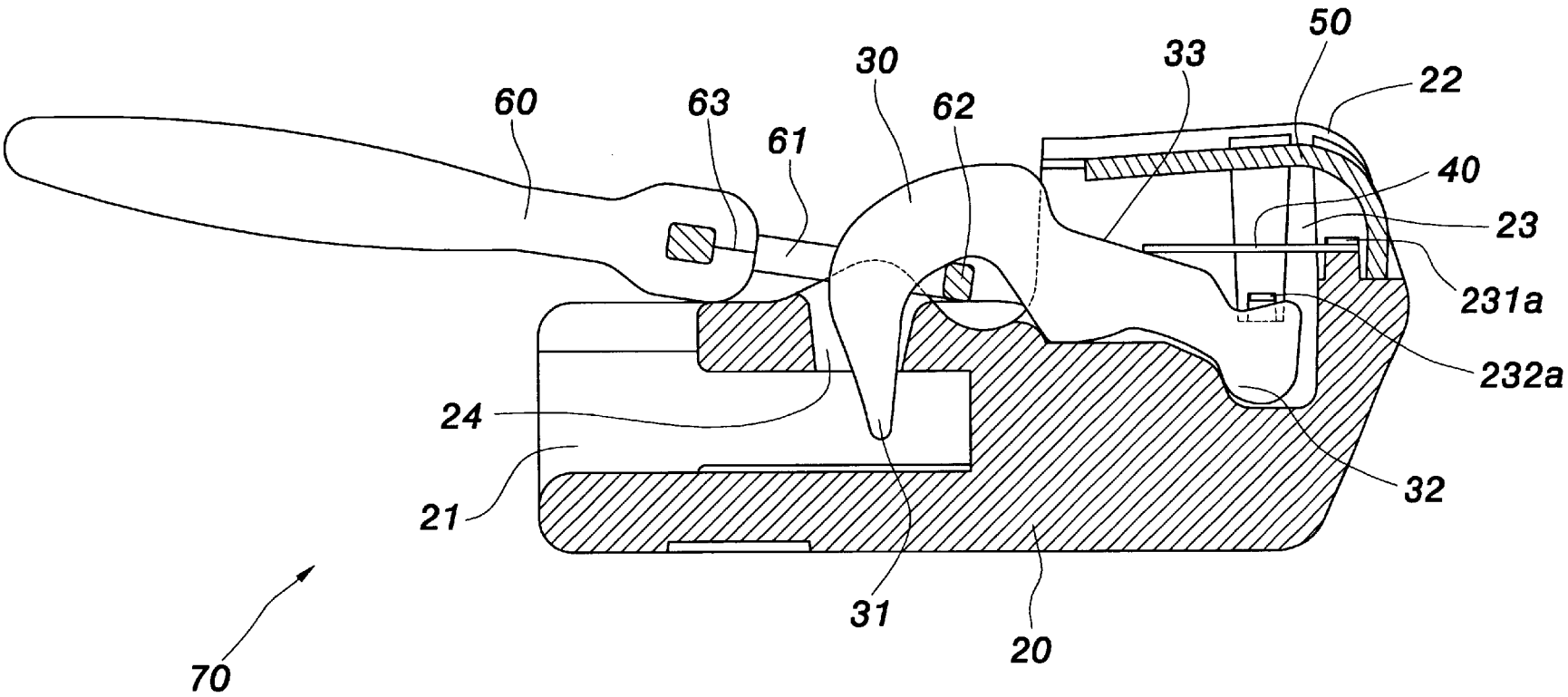
FIG. 4 is a side view in section of FIG. 3.
Figure 5:
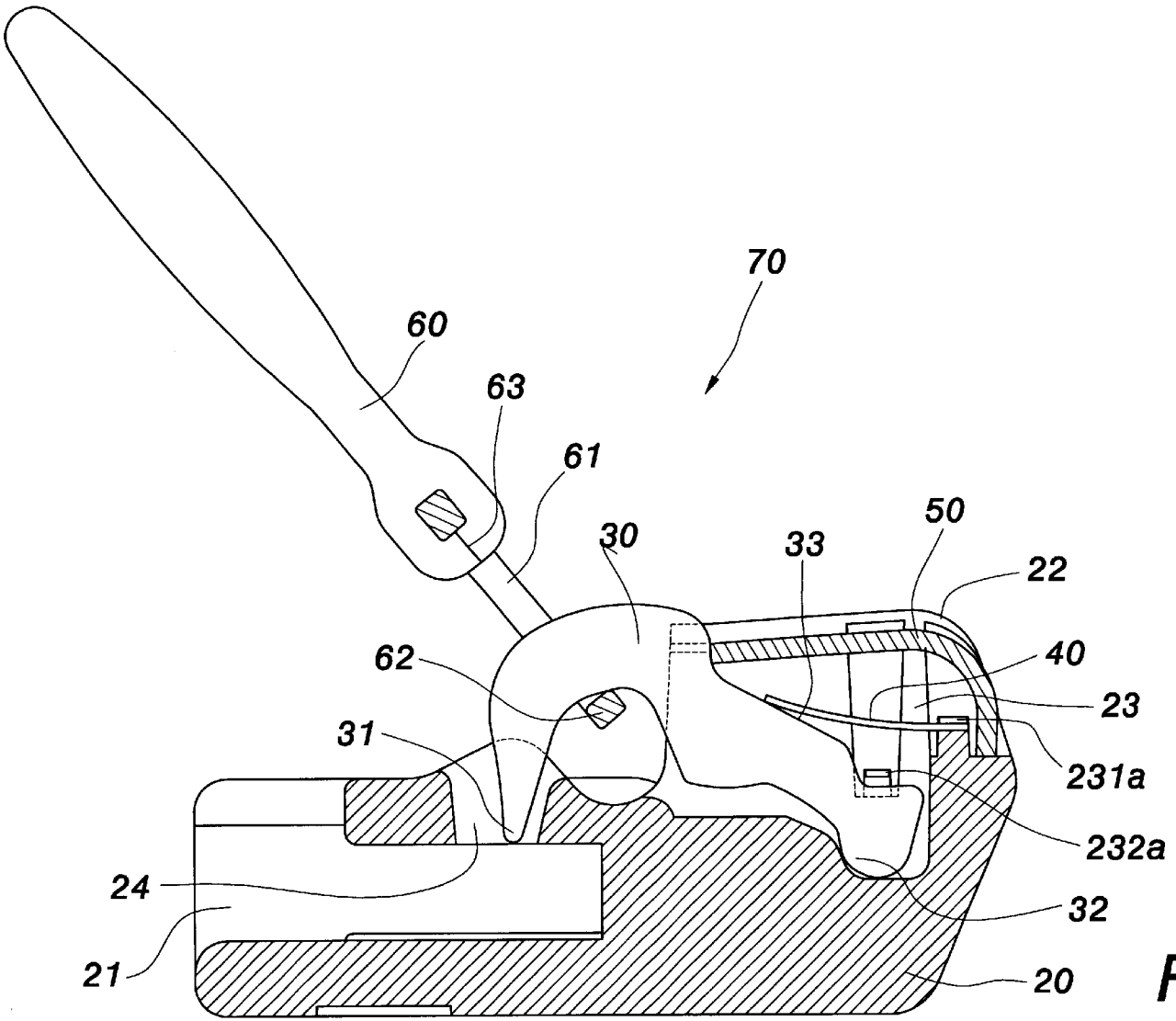
FIG. 5 is a sectional view showing the pull tab pulled upwardly outwards, the hooked tip of the hook plate disengaged from the hook hole of the slide base according to the present invention.
Figure 6:
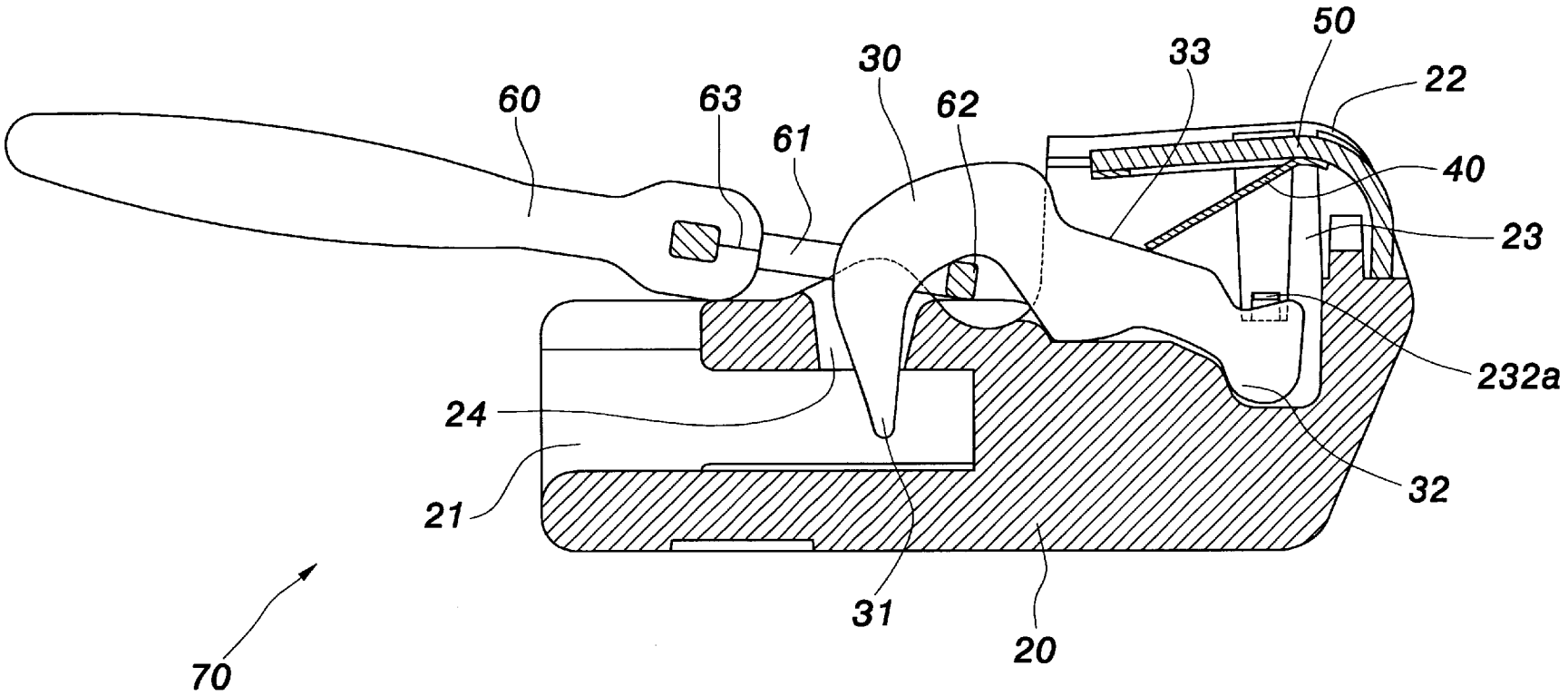
FIG. 6 is a sectional view of a second embodiment of the present invention.
Figure 7:
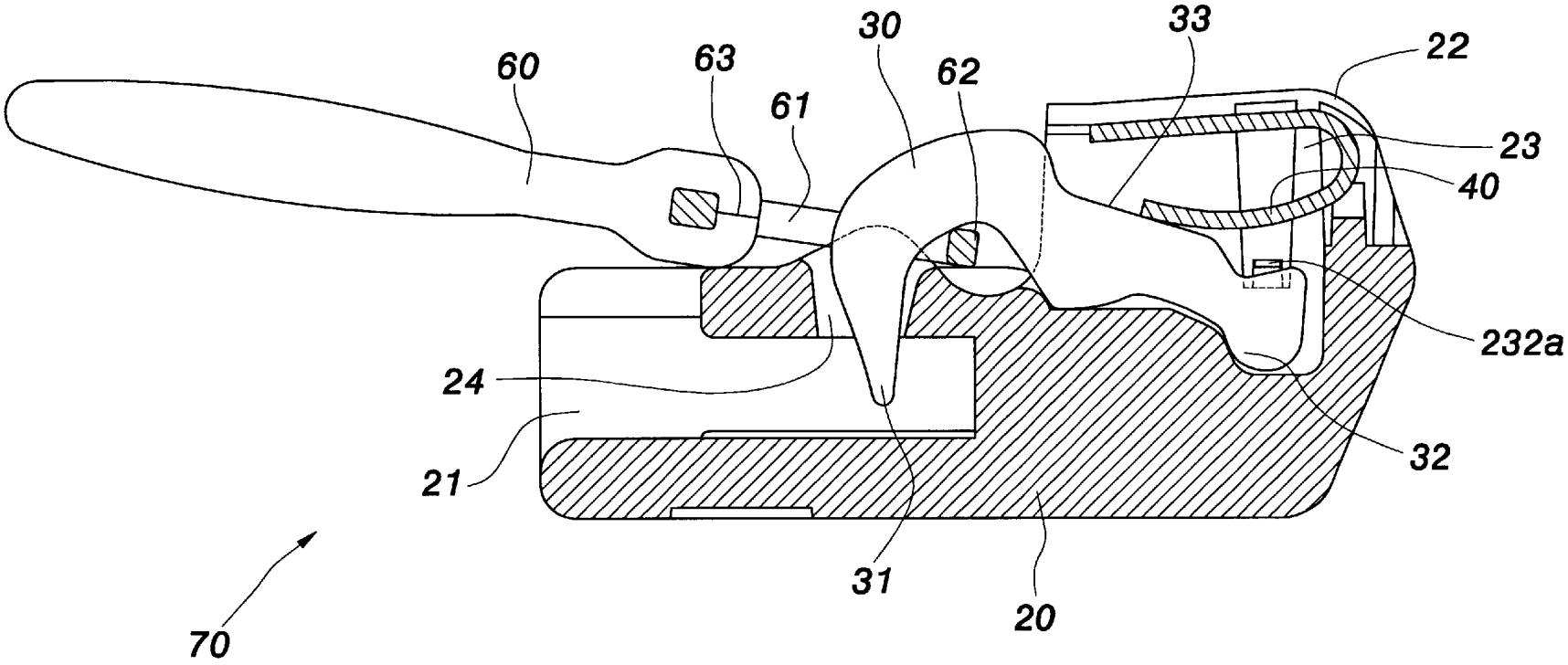
FIG. 7 is a sectional view of a third embodiment of the present invention.

The spring element 40 may be variously shaped. In the embodiment shown in FIG. 2, the spring element 40 is a flat spring plate. In the embodiment shown in FIG. 6, the spring element 40 is a curved clamping plate. In the embodiment shown in FIG. 7, the spring element 40 is a U-shaped spring plate. When installed, the spring element 40 is pressed on the top face 33 of the hook plate 30 to hold the hook plate 30 in position, keeping the hooked tip 31 of the hook plate 30 hooked in the hook hole 24 of the slide base 20 (see FIG. 4). When pulling the hook plate 30 upwardly outwards against the spring force of the spring element 40, the hooked tip 31 of the hook plate 30 is disengaged from the hook hole 24 of the slide base 20 (see FIG. 5).

The locating plate 50 is made of made of metallic material, for example, aluminum alloy or zinc alloy, and fixedly fastened to the recessed receiving chamber 23 of the partition block 22 of the slide base 20 by stamping to secure the spring element 40, the hook plate 30 and the coupling ring 62 to the slide base 20 (see FIG. 3).

According to the present invention, the slide base 20, the hook plate 30 and the spring element 40 are fastened together by stamping. Because the assembly process of the zipper slide 70 eliminates manual riveting, the manufacturing cost of the zipper slide 70 is low.

A prototype of zipper slide for invisible zipper has been constructed with the features of FIGS. 2~7. The zipper slide for invisible zipper functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A zipper slide for an invisible zipper comprising:

a slide base, said slide base having a longitudinally extended upright partition block, said upright partition block comprising a recessed receiving chamber and a hook hole in one end of said recessed receiving chamber, said receiving chamber including a first receiver having a pair of distal end portions and a second receiver having a pair of distal end portions;

a hook plate displaceably mounted in said slide base, said hook plate having one end terminating in a hooked tip extending into said hook hole of said partition block of said slide base, an opposite end terminating in a bearing point supported in said first receiver of said recessed receiving chamber of said base, and a top face disposed at a top side thereof between said hooked tip and said bearing point, said pair of distal end portions of said first receiver being upset by stamping to retain said bearing point within said first receiver;

a flat spring plate having one end mounted in said second receiver of said recessed receiving chamber of said slide base and an opposing end pressed on the top face of said hook plate, said pair of distal end portions of said second receiver being upset by stamping to retain said one end of said spring plate within said second receiver;

a locating plate fixedly fastened to the recessed receiving chamber of said partition block of said slide base by stamping;

a coupling ring coupled to the hooked tip of said hook plate, said coupling ring defining a hole through which the hooked tip of said hook plate passes; and a pull tab coupled to the hole of said coupling ring.

* * * * *